US009649747B2

(12) United States Patent
Bureloux et al.

(10) Patent No.: US 9,649,747 B2
(45) Date of Patent: May 16, 2017

(54) GRINDING WHEEL FOR SHAPING FLAT GLASS

(75) Inventors: Dominique Bureloux, Ognes (FR); Thierry Dumenil, Margny les Compiegne (FR); Sebastien Wery, Compiegne (FR); Adeline Girod, Paris (FR); John Tunstall, Buffalo Grove, IL (US)

(73) Assignee: SAINT-GOBAIN GLASS FRANCE, Courbevoie (FR)

( * ) Notice: Subject to any disclaimer, the term of this patent is extended or adjusted under 35 U.S.C. 154(b) by 242 days.

(21) Appl. No.: 14/343,609

(22) PCT Filed: Aug. 14, 2012

(86) PCT No.: PCT/FR2012/051895
§ 371 (c)(1),
(2), (4) Date: Mar. 27, 2014

(87) PCT Pub. No.: WO2013/034828
PCT Pub. Date: Mar. 14, 2013

(65) Prior Publication Data

US 2015/0283673 A1 Oct. 8, 2015

(30) Foreign Application Priority Data

Sep. 9, 2011 (FR) ..... 11 58029

(51) Int. Cl.

| | |
|---|---|
| ***B24D 3/06*** | (2006.01) |
| ***B24B 9/10*** | (2006.01) |
| ***C22C 26/00*** | (2006.01) |
| ***B24D 5/00*** | (2006.01) |
| ***B24D 9/10*** | (2006.01) |

(52) U.S. Cl.
CPC ..... *B24D 3/06* (2013.01); *B24B 9/10* (2013.01); *B24D 5/00* (2013.01); *B24D 9/10* (2013.01); *C22C 26/00* (2013.01); *Y10T 428/24355* (2015.01)

(58) Field of Classification Search
CPC .. B24D 3/06; B24D 5/00; C22C 26/00; B24B 9/10; Y10T 428/24355
See application file for complete search history.

(56) References Cited

U.S. PATENT DOCUMENTS

| | | | | |
|---|---|---|---|---|
| 3,243,922 | A * | 4/1966 | Highberg | B24B 7/241 451/260 |
| 2003/0176155 | A1* | 9/2003 | Wiand | B24B 9/146 451/461 |
| 2004/0023599 | A1 | 2/2004 | Tunstall | |
| 2009/0017736 | A1* | 1/2009 | Block | B24B 9/10 451/260 |
| 2009/0188171 | A1* | 7/2009 | Bonneau | C22C 1/0425 51/309 |

OTHER PUBLICATIONS

International Search Report Issued Nov. 12, 2012in PCT/FR12/051895 Filed Aug. 14, 2012.

* cited by examiner

*Primary Examiner* — Laura Auer
(74) *Attorney, Agent, or Firm* — Oblon, McClelland, Maier & Neustadt, L.L.P.

(57) ABSTRACT

A grinding wheel is suited for shaping glass, notably glass that is less than or equal to 4 mm thick. This grinding wheel has at least one abrasive portion formed of at least one metal binder and of diamonds distributed in the binder. The binder has a Rockwell B hardness of between 95 and 105 and is tungsten-based. The diamonds have a size of between 75 and 95 μm and a concentration of between 2.2 ct/cm$^3$ and 2.64 ct/cm$^3$. Glass, in particular for shaping motor-vehicle glazing units, can be shaped with this grinding wheel, making it possible to achieve travel speeds greater than or equal to 30 m/min.

11 Claims, No Drawings

GRINDING WHEEL FOR SHAPING FLAT GLASS

The present invention relates to a new grinding wheel for shaping glass, notably glass that is called "flat" (sheet glass or glazing unit, whether the sheet is flat or curved notably), in particular glass that is called "thin" (less than or equal to 2.6 mm thick, in particular less than or equal to 2.1 mm thick), and if necessary glass that is called "thick", that is to say more 2.6 mm thick (in particular between 2.6 mm and 4 mm), notably in the motor-vehicle field, said grinding wheel being designed in particular for the shaping of vehicle glazing units such as windshields, the glazing units for roofs or for laminated side windows, or if necessary of the rear window type, etc. The invention also relates to a method for manufacturing said grinding wheel and its use for shaping glazing units as aforementioned, notably for motor vehicles, or any other glass, in particular less than or equal to 4 mm thick, notably less than or equal to 2.6 mm thick. The invention also relates to a new method for shaping glass, in particular for shaping motor-vehicle glazing units, using this grinding wheel and notably making it possible to achieve shaping travel speeds greater than or equal to 30 m/min.

The invention relates to the field of transforming flat glass. Grinding wheels have been specially developed for the motor-vehicle field, but may be used for any glassmaking application using glass elements of the same thickness. These shaping grinding wheels for hard materials such as glass consist of abrasive materials, such as synthetic diamonds which, by virtue of their properties of great hardness and of heat resistance, can cut many materials. These diamonds or abrasive materials are usually located in a matrix or binder, which is usually metallic (notably cobalt-based), this assembly designed for shaping usually surrounding a central core, for example a metallic core (notably in stainless steel), and also being inserted as necessary between two metallic portions that may notably enhance its mechanical strength, make it easier to attach, balance it, etc.

In the shaping of glass, account is usually taken of four important parameters: the shaping travel speed (in m/min), the quality of the shaping seal (evaluated by observing the concentration and the size of the chips induced by the shaping, the quality of the required seal depending on the specification set by the motor-vehicle manufacturer and being evaluated in the present application by a benchmark apparatus GQM marketed by Bystronic Machinen AG, this apparatus calculating the size and the concentration of the chips), the lifetime of the grinding wheel, and the frequency of brightening the grinding wheel (brightening usually consisting in cleaning the grinding wheel and resetting the diamonds in the surface, this operation causing a loss of time and wear of the grinding wheel by abrading its metallic binder). The shaping travel speed is usually less than or equal to 20-22 m/min on average, and the frequency of brightening is usually of the order of one brightening every 90 to 135 m of shaped glass (namely every 20 or 30 glass elements for perimeters of glass of the order of 4.5 m).

Increasing the shaping travel speed would make it possible to reduce the cycle times (and thus increase productivity) and to reduce investments on production machines. Therefore, it would be possible to feed an oven with, for example, one or two shaping machines instead of three currently (for glass used in laminates); however, such a speed poses the problem of greatly stressing the shaping grinding wheel.

Accordingly, the grinding wheels that are currently available on the market are not suitable for high-speed shaping which is still difficult to achieve for the following reasons notably:

- at travel speeds of at least 30 m/min, burning (temperature too high at the point of glass/grinding wheel contact causing the glass to be torn away and not shaped, this phenomenon, that can be seen and identified, being characterized by a white line on the surface of the glass, flames also appearing in the spray housing during shaping) appears very rapidly (after a few glazing units), making the quality of the shaped seal unacceptable,
- at travel speeds of at least 30 m/min, the frequency of brightening is much grater (possibly rising to one brightening every 22.5 m to 45 m (or every 5 to 10 shaped glass elements for perimeters of glass of the order of 4.5 m).
- the quality of the seal also varies during the manufacturing method (occasional degradation).

The present invention has therefore sought to develop a new grinding wheel for shaping glass, in particular flat glass, and notably thin glass, or even thick glass, suitable for the motor-vehicle field notably, making it possible amongst other things to shape monolithic glass elements used in laminated glazing units such as windshields, laminated glazing units for roofs or motor-vehicle side laminated glazing units, or the shaping of any other glass element (or glassmaking material) which is less than or equal to 4 mm thick notably, in particular less than or equal to 2.6 mm thick (thin glass), or even less than or equal to 2.1 mm, said grinding wheel making it possible to increase the shaping travel speed (in particular making it possible to obtain a shaping travel speed greater than or equal to 30 m/min), nevertheless without having the drawbacks or incompatibilities seen above, in particular making it possible to maintain good quality of the shaping seal (notably a number of visible defects, that is to say a number of defects longer than 250 μm in glass surface area, less than 7 per decimeter), while offering a service life equal to at least 50 km of shaped seal, with a brightening frequency not exceeding 1 brightening every 90 m of shaped glass (that is one brightening every 20 glass elements for usual perimeters of glass of the order of 4.5 m).

This object is achieved according to the invention by a shaping grinding wheel, designed for shaping glass, notably flat glass, that is less than or equal to 4 mm thick, in particular having a thickness of between 1.6 and 3.85 m, and notably thin glass, less than or equal to 2.6 mm thick, in particular between 1.6 and 2.6 mm thick, but also if necessary thick glass, with a thickness in particular between 2.6 and 3.85 mm, this grinding wheel being suitable and advantageously intended for high-speed shaping, this grinding wheel comprising at least one abrasive portion, designed for shaping, said abrasive portion being formed of at least one metallic binder (at least one metal, this binder advantageously being an alloy in the present invention) and of diamonds distributed in the binder, said binder having a Rockwell B hardness of between 95 and 105 and being tungsten-based, and the diamonds having a size of between 75 and 95 μm and a concentration of between 2.2 ct/cm$^3$ and 2.64 ct/cm$^3$ (the concentration in the abrasive portion, formed of the binder and the diamonds).

The grinding wheel according to the invention is particularly suitable for the shaping of flat glass, as indicated above, notably of flat glass originating from a float (or obtained by a float process), in particular sheet glass or glazing used in the motor-vehicle field, and notably for the shaping of thin glass, less than or equal to 2.6 mm thick, in particular less than or equal to 2.1 mm thick (notably shaping of glazing units for laminates intended to form laminated windshields, roofs or side windows, etc.), but if necessary it is also suitable with advantages for the shaping of thick (flat) glass, notably between 2.6 and 4 mm thick, notably between 2.6 and 3.85 mm thick (shaping of sheets of glass or glazing units used as monolithic glass elements in the motor-vehicle field in order to form for example motor-vehicle rear windows, roofs, automobile side windows, etc.).

The grinding wheel according to the invention is particularly advantageous because it makes it possible to shape at travel speeds equal to 30 m/min at least, while retaining a good quality of seal, a brightening frequency not exceeding one brightening every 90 m and a service life equal to at least 50 km of shaped glass. The combination of features mentioned in the definition of the invention makes it possible to increase the shaping speed without suffering the aforementioned drawbacks.

The grinding wheel according to the invention generally takes the form of a disk with a diameter of between 130 and 250 mm, for example of the order of 150 mm, formed of a central, metallic (annular) core (for example in stainless steel) and a peripheral crown (or ring) (surrounding the core on the end face) having an abrasive (usually median) portion, set between two metallic portions (usually made of stainless steel like the core). The grinding wheel is obtained by assembling the metallic portions, already essentially being shaped (all the aforementioned portions except for the abrasive portion) and by adding in the space between the peripheral metallic portions the abrasive mixture (the binder, in the form of a mixture of metallic powders, and the diamonds), then by heating the assembly under pressure in order to carry out the sintering of the binder and the cohesion of the various portions. One or more profiles (usually two profiles at most are provided in the thickness or over the end face of the abrasive portion) appropriate for the intended shaping (for example at least one profile required to obtain a rounded edge on the periphery of a glazing unit) can then be given to the abrasive portion on its apparent periphery, for example by means of spark machining, these profiles subsequently being rebrightened or maintained with the aid of appropriate brightening sticks (these sticks usually being aluminum-based). The thickness of the abrasive portion for the intended preferred motor-vehicle applications is usually between 6.4 and 10 mm, the depth of the abrasive portion inside the grinding wheel (up to the metallic core) usually being of the same order (between 6.4 and 10 mm).

As mentioned above, the combination of the selected binder and diamond characteristics makes it possible to obtain the aforementioned advantages. In particular, the binder of the abrasive portion is chosen so as to have a Rockwell B hardness of between 95 and 105, this hardness being measured according to the EN ISO 6508-1 standard, the hardness being associated notably with the composition of the binder and notably influencing the service life of the grinding wheel and the frequency of brightening. As indicated in the definition of the invention, the binder is tungsten (metal)-based, tungsten advantageously being its main component, the binder in particular being formed (based on) of at least 58% (and preferably at least 59%, notably at least 60%, in particular at least 61%) and preferably at most 75% by weight of tungsten (powder), the size of the particles of tungsten/of said powder advantageously not exceeding 100 μm.

As mentioned above, in addition to the tungsten, the main component of the binder, the latter is also advantageously formed from other metals and constitutes an alloy of these various metals. Advantageously, the composition (expressed in percentages by weight) of the binder is as follows (that is to say the binder is obtained from the mixture of the following (metal) components, their cohesion notably being obtained by sintering as mentioned above):

tungsten (powder) 58-75%, in particular 59-75%,
bronze (powder) 30-37%, in particular 28-33%
chrome (powder) 0.5-5%, in particular approximately 1%
nickel (powder) 0.5-5%, in particular approximately 1%, 75 to 85% by weight of the bronze being formed of copper and 15 to 25% by weight being formed of tin, in particular formed of approximately 80% of copper and 20% of tin.

The size of the bronze particles is advantageously chosen to be smaller than 100 μm, that of the chrome (or chromium) particles is chosen to be smaller than 50 μm, and that of the nickel particles is chosen to be smaller than 50 μm. The ratio of tungsten may if necessary be higher for the shaping of thick glass than for thin glass in the present invention, being for example notably of the order of 61 to 75%, for example of the order of 65 to 70%, in case of thick glass in particular or then being able to be rather of the order of 59 to 70%, for example of the order of 59 to 65%, in the case of thin glass, notably.

The binder thus selected notably helps to obtain the desired brightening frequency and service life.

The diamonds that are present in the abrasive portion are usually synthetic. Their size (expressed by the arithmetic mean of the diameters of the circles or spheres in which the diamonds are included and usually evaluated by sieving notably according to the ANSI B74-16 or FEPA standard) is chosen in the present invention to be between 75 and 95 μm (or else between 180 and 240 mesh, the correspondence between the size in mesh and the size in μm being evaluated according to the FEPA (Fédération Européenne des fabricants de produits abrasifs) (the Federation of European Producers of Abrasives) standard). The concentration of said diamonds according to the invention (usually evaluated by weighing during the manufacture of the grinding wheel) is also between 2.2 ct/cm$^3$ (that is to say carats per cm$^3$) and 2.64 ct/cm$^3$, which also corresponds to a concentration of between 0.44 g/cm$^3$ and 0.528 g/cm$^3$ of diamonds in the abrasive portion (also corresponding to a ratio of between 10 and 20% by volume of diamonds in the abrasive portion).

According to an advantageous embodiment, in particular when the tungsten content of the selected binder is lowest (for example is between 58 and 70%), the diamonds are chosen to have (for most of them, in particular at least 90% and preferably 100%) at least one coating (in particular one layer or even more) of titanium or if necessary a titanium-based coating, the ratio of titanium preferably being between 2 and 10% by weight of said coated diamond (for example being of the order of 6% by weight). This coating or covering is carried out in particular on the diamonds before manufacture of the grinding wheel, for example by physical deposition in a vacuum of a thin film in the vapor phase (PVD or "physical vapor deposition", for example by cathodic sputtering) or by electroplating or by chemical vapor deposition (CVD) on the diamonds before they are used to manufacture the grinding wheel according to the invention. The high ratio of tungsten and/or the presence of this titanium coating on the surface of the diamonds notably allows the formation of carbide at the binder/diamond interface when the grinding wheel is cured during its manufacture, which tends to limit shedding of the diamonds during the shaping process.

As indicated above, the grinding wheel according to the invention makes it possible to shape at travel speeds equal to 30 m/min at least; accordingly it is possible to qualify it as a high-speed grinding wheel.

A further object of the invention in this regard is a new method (or a new operation) for shaping glass, in particular for shaping sheets of glass or glazing units, in particular for motor vehicles, such as those used to form windshields, glazing units for roofs or for side windows, with a thickness that is less than or equal to 4 mm, in particular less than or equal to 2.6 mm, notably less than or equal to 2.1 mm, using the aforementioned grinding wheel and thus making it possible notably to achieve shaping travel speeds greater than or equal to 30 m/min.

In one advantageous embodiment, this method is also characterized by a ratio of the rotation speed of the grinding wheel (in m/min, this rotation speed usually varying between 2400 and 4200 m/min) to the shaping travel speed (in m/min, that is to say in meters of shaped glass per minute, this shaping travel speed usually varying between 20 and 33 m/min, the grinding wheel according to the invention making it possible to work both at high speed and at low speed, the advantage in the latter case notably being a significantly improved service life of the grinding wheel) of between 60 and 180, such a ratio making it possible to obtain good efficiency of the grinding wheel according to the invention at the same time as a high travel speed.

The invention also covers a method for manufacturing glazing units notably for motor vehicles, in particular windshields, glazing units for roofs or for side windows, incorporating a shaping operation as previously claimed according to the invention, and a device for manufacturing glazing units, incorporating the grinding wheel according to the invention.

There are many advantages of the shaping method or operation according to the invention:

- it is possible to reduce investment costs by reducing the number of shaping machines required to feed the forming ovens,
- it is also possible to reduce the cycle times (the saving of time for the shaping of one glass element to the next being of the order of 30% relative to the usual shaping methods) during shaping, thus creating productivity gains (a reduction of several %, or even tens of % in the cycle time notably),
- on a production line for manufacturing windshields, motor-vehicle glazing units for roofs or side windows, it is also possible to limit line stoppages, the shaping at high speeds making it possible to ensure continuity in the subsequent feeding of the screen-printing machine without a slow-down associated with the shaping of the glass element.

The grinding wheel according to the invention is particularly suitable for the shaping of the periphery of the glass elements, for the purpose of giving a particular profile (by forming for example a rounding on the peripheries and thus removing the sharp corners) to the edge of the glass elements designed to form the desired glazing units. In the motor-vehicle field, these glass element originate notably from float methods and usually undergo the operation of cutting and shaping after formation. Usually, the sheets of glass originating from the float process first undergo a stage of cutting to the desired shape, and are then shaped, washed, before if necessary undergoing a screen-printing step, before the step of forming or bending (for example by placement on an appropriate metallic bending frame or armature then transfer to an oven, for example at a temperature of the order of 650° C.), designed to give if necessary the appropriate curvature to the glazing unit (in particular for motor-vehicle applications), this forming or bending being able to be carried out simultaneously on several sheets designed to be combined within one and the same laminate, the glass sheets thus formed then being cooled if necessary and associated as required with one or more plastic inserts of similar dimensions before calendaring, heating, and placement of a peripheral seal as appropriate.

A cooling liquid (in particular water with, if necessary, one or more cooling additives) is usually used in combination with the grinding wheel at the point of contact between the grinding wheel and the glass in order to wash away the glass particles and dissipate the energy produced.

The grinding wheel according to the invention has shown itself to be perfectly suitable to advantageously replace the usual grinding wheels in existing installations for shaping and manufacturing glazing units, in particular for motor vehicles, since the mechanisms governing the removal of material are usually complex, the changes of grinding wheel or of its environment being able to have a considerable influence.

The invention also relates to a glazing unit, in particular a windshield, a glazing unit for motor-vehicle roofs or side windows, obtained using the shaping or glazing-unit production method according to the invention, and to a vehicle incorporating said glazing unit.

The present invention also relates to a method for producing grinding wheels according to the invention. These grinding wheels are made from the mixture of metallic powder(s) (that are to form the binder) and of diamonds mentioned above in the definition of the grinding wheel according to the invention, this mixture being inserted between the metallic portions as mentioned above, then the formed assembly being brought to a high temperature, notably higher than 800° C. and usually below 980° C., and in particular between 900 and 960° C., and pressurized, notably between 1500 and 2500 psi (pound per square inch, corresponding to a pressure of between 103.4 and 172.4 bar approximately) for a period for example of between 45 min and 1 hour min (this operation corresponding to a sintering step, lasting for approximately 1 h on average), the assembly formed by the metallic binder incorporating the diamonds which is tightly wedged between the metallic portions then being stripped from the mold in the form of a grinding wheel and then the cutting profile of the grinding wheel being made on the abrasive portion for example by spark erosion. Before it is used on a production line, the grinding wheel obtained is also preferably brightened with the aid of one or two brightening sticks, which may be identical or different, for example a stick called soft and a stick called hard, and the concentricity of the grinding wheel is verified, these two operations usually being carried out before the grinding wheel is packaged.

The present invention will be better understood and other details and advantageous features of the invention will appear on reading the following example of a grinding wheel produced according to the invention.

EXAMPLE

A grinding wheel according to the invention has been produced by inserting between the stainless metallic portions a mixture designed to form the abrasive portion and then by heating the assembly under pressure in order to have the various portions cohere, then by generating a shaping profile on the abrasive portion by spark erosion, the mixture designed to form the abrasive portion being formed of the following components:

approximately 85% by volume of binder with the following composition (given by weight with respect to the binder);

tungsten (powder): 61% bronze (powder): 37% chrome (powder): 1% nickel (powder): 1%, the bronze being formed of approximately 80% copper and 20% tin, this binder having a Rockwell B hardness of approximately 100, approximately 15% by volume of diamonds (concentration of the order of 2.64 ct/cm$^3$ in the abrasive portion of the grinding wheel), said diamonds having a size of 220 mesh (or 76 μm), being covered with titanium (at a rate by weight of 6% of covered diamond).

It has been observed that this grinding wheel made it possible to obtain a shaping travel speed of at least 30 m/min (the rotation speed of the grinding wheel being of the order of 60 m/s) while maintaining a good quality of the shaping seal (notably with a number of visible defects of less than 6 per decimeter) and while providing a service life of at least 50 km at least of shaped seal, with a brightening frequency every 25 to 30 glass elements (or every 112.5 to 135 m of shaped glass, the perimeter of the shaped glass elements in this example being 4.5 m).

The glazing unit obtained by shaping by using the grinding wheel according to the invention can be used for example in a motor vehicle or transport vehicle, such as a windshield, a glazing unit for a roof or for a side window, etc.

The invention claimed is:

1. A grinding wheel, comprising:

at least one abrasive portion comprising at least one metallic binder and diamonds distributed in the metallic binder, wherein the metallic binder comprises:

from 58 to 75% by weight of tungsten;

from 30 to 37% by weight of bronze, wherein the bronze comprises from 75 to 85% by weight of copper and from 15 to 25% by weight of tin;

from 0.5 to 5% by weight of chrome; and from 0.5 to 5% by weight of nickel, wherein the metallic binder has a Rockwell B hardness of between 95 and 105, and wherein the diamonds have a size of between 75 and 95 μm and a concentration of between 2.2 ct/cm$^3$ and 2.64 ct/cm$^3$.

2. The grinding wheel of claim 1, configured for shaping glass that is less than or equal to 4 mm thick, and/or configured for high-speed shaping.

3. The grinding wheel of claim 1, wherein the diamonds are coated with titanium.

4. A method for manufacturing the grinding wheel of claim 1, the method comprising:

producing a mixture of the metallic binder and diamonds;

heating the mixture to high temperature;

pressurizing the mixture; and removing an assembly comprising the metallic binder incorporating the diamonds in a form of a grinding wheel from a mold.

5. A method for shaping glass, the method comprising:

grinding a sheet of glass with the grinding wheel of claim 1 at a shaping travel speed greater than or equal to 30 m/min.

6. The method of claim 5, wherein a ratio between a rotation speed of the grinding wheel and the shaping travel speed is between 60 and 180.

7. A method for manufacturing a glazing unit, the method comprising:

grinding a glazing unit with the grinding wheel of claim 1 at a shaping travel speed greater than or equal to 30 m/min.

8. A device, comprising the grinding wheel of claim 1.

9. The grinding wheel of claim 1, configured for shaping glass that is less than or equal to 2.6 mm thick.

10. The method of claim 7, wherein the glazing unit is a windshield, roof, or side window of a motor vehicle.

11. The method of claim 4, wherein heating the mixture comprises heating to a temperature of higher than 800° C. and pressurizing to several bar.

* * * * *